US010814330B2

(12) United States Patent
Kjaerran et al.

(10) Patent No.: US 10,814,330 B2
(45) Date of Patent: Oct. 27, 2020

(54) ROTOR LOCKING DEVICE

(71) Applicant: SANDVIK INTELLECTUAL PROPERTY AB, Sandviken (SE)

(72) Inventors: Knut Kjaerran, Svedala (SE); Andreas Forsberg, Malmo (SE); Rowan Dallimore, Somerset (GB)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 16/314,694

(22) PCT Filed: Jul. 5, 2016

(86) PCT No.: PCT/EP2016/065800
§ 371 (c)(1),
(2) Date: Jan. 2, 2019

(87) PCT Pub. No.: WO2018/006940
PCT Pub. Date: Jan. 11, 2018

(65) Prior Publication Data

US 2019/0314824 A1 Oct. 17, 2019

(51) Int. Cl.
*B02C 13/31* (2006.01)
*B02C 18/24* (2006.01)
(Continued)

(52) U.S. Cl.
CPC ..... *B02C 13/31* (2013.01); *B02C 13/30* (2013.01); *B02C 18/24* (2013.01); *B02C 18/38* (2013.01); *B02C 2013/29* (2013.01)

(58) Field of Classification Search
CPC ..... B02C 13/30; B02C 13/31; B02C 13/26; B02C 2013/29; B02C 18/24; B02C 18/38
See application file for complete search history.

(56) References Cited

U.S. PATENT DOCUMENTS 2,679,983 A * 6/1954 Happe ..... B02C 13/30 241/191
4,978,080 A * 12/1990 Weitekamp ..... B02C 13/30 241/101.2

(Continued)

FOREIGN PATENT DOCUMENTS

AU 2015242962 A1 5/2016
DE 102010015438 A1 10/2011

(Continued)

*Primary Examiner* — Faye Francis
(74) *Attorney, Agent, or Firm* — Corinne R. Gorski

(57) ABSTRACT

A rotor locking device in a crusher is arranged for locking a rotational position of a rotor shaft. A shaft engager includes a female toothed mating surface for coaxial engagement with a male mating surface at an end of the rotor shaft to rotationally interlock the same. A fastening portion with engager apertures overlaps with a bearing mount surrounding the rotor shaft so it can be fastened therewith. The engager apertures are circumferentially elongated in order to accommodate alignment with fastening points in the bearing mount, at least when a closest rotational mating position is chosen for alignment. This enables any rotational position of the rotor shaft to be locked for safety before having to access the crusher chamber, especially when the rotor of the crusher has become blocked and requires maintenance.

12 Claims, 9 Drawing Sheets

(51) Int. Cl.

| | |
|---|---|
| ***B02C 13/30*** | (2006.01) |
| ***B02C 18/38*** | (2006.01) |
| *B02C 13/26* | (2006.01) |

(56) References Cited

U.S. PATENT DOCUMENTS

| | | | | |
|---|---|---|---|---|
| 7,744,302 | B2 * | 6/2010 | Rodriguez | B02C 13/14 175/415 |
| 8,393,820 | B2 * | 3/2013 | Rodriguez | B02C 13/14 175/320 |
| 2009/0000341 | A1 * | 1/2009 | Rodriguez | B02C 13/14 70/182 |
| 2010/0266335 | A1 * | 10/2010 | Rodriguez | B02C 13/14 403/355 |
| 2013/0284839 | A1 | 10/2013 | Faure | |

FOREIGN PATENT DOCUMENTS

| | | | |
|---|---|---|---|
| WO | 2010071550 | A2 | 6/2010 |
| WO | 2011129742 | A1 | 10/2011 |
| WO | 2011129744 | A1 | 10/2011 |
| WO | 2013189691 | A1 | 12/2013 |
| WO | 2013189687 | A1 | 5/2017 |

* cited by examiner

ROTOR LOCKING DEVICE

RELATED APPLICATION DATA

This application is a § 371 National Stage Application of PCT International Application No. PCT/EP2016/065800 filed Jul. 5, 2016.

FIELD OF INVENTION

The present invention relates to a rotor locking device for adjusting and locking the rotational position of a rotor in a crusher, e.g. a horizontal shaft impact crusher. Particularly, the locking device is mountable to an external region of the crusher.

BACKGROUND ART

Horizontal shaft impact crushers (HSi crushers) are utilized in many applications for crushing hard material, such as pieces of rock, ore etc. A HSi crusher comprises a crushing chamber housing an impeller (alternatively termed a rotor) that is driven to rotate about a horizontal axis. Pieces of rock are fed towards the impeller and are struck by impeller mounted hammer elements. The rock pieces are disintegrated initially by striking contact with the hammer elements and are then accelerated and thrown against breaker plates (typically referred to as curtains) to provide further disintegration. The action of the impeller causes the material fed to the horizontal shaft impact crusher to move freely in the chamber and to be crushed upon impact against the hammer elements, against the curtains, and against other pieces of material moving around at high speed within the chamber. Example HSi crushers are described in WO 2010/071550; WO 2011/129744; WO 2011/129742; WO 2013/189691 and WO 2013/189687.

As will be appreciated, the hammer wear parts require regular maintenance and replacement. Hammer replacement necessitates rotational adjustment of the rotor once the crusher has stopped to position one of the rotor hammer rows to top dead-centre so that the worn hammers can be removed and replacement elements inserted. Additionally, the separation distance between the hammer row and a toe of the curtain requires both an initial calibration and periodic adjustment to achieve and maintain a desired particle size distribution. Again, this requires personnel to rotationally adjust the position of the rotor.

Conventionally, the impact rotor is adjusted manually by an operator leaning into the crushing chamber and manually turning the rotor by hand. This form of adjustment poses significant health and safety risks to service personnel. In an attempt to address this, US 2013/0284839 describes an impact mill having a rotor positioning device mounted internally within the crusher comprising a driven indexing component that provides rotation of the rotor (and in particular the hammer rows) when the crusher is inoperative.

However, the integral powered positioning device of US 2013/0284839 is disadvantageous for a number of reasons. In particular, such a device adds weight to the crusher which is undesirable for transportation and installation. Additionally, the device increases the complexity of the crusher internal construction and introduces additional servicing and maintenance problems with access being required to the internally mounted device when components wear or the device malfunctions. Accordingly, what is required is a rotor positioning device that addresses these problems.

When a crusher becomes overloaded with hard material it can become blocked, causing the rotor to stall. In such a case the blockage must be removed by gaining access to the interior of the machine, but a danger is presented to personnel in that, once the blocking material is removed, the rotor is again free to rotate. Typically it is not possible to lock a rotor in any position, corresponding to where a blockage occurs, especially from outside the machine, prior to access doors being opened.

SUMMARY OF THE INVENTION

It is an objective of the present invention to facilitate the rotational locking of a rotor of a crusher machine by use of an externally mounted device. It is also an objective to provide a rotor positioning/locking device that is compatible with a variety of different HSi crushers and requires little or no modification to the crusher and in particular to the internal components associated with the shaft of the rotor.

It is a further specific objective to provide a rotor locking device that may be retro-fitted to existing HSi crushers to enable operating personnel to manually adjust and/or lock the rotational position of the rotor via an external region of the crusher. The general positioning/locking mechanism described by the invention can potentially be adapted to other crusher machine types, e.g. a hammer mill or other machines that require maintenance of rotary parts.

The objectives are achieved via a rotor locking device located at an external region of the crusher mainframe at a position close to or adjacent the non-driven end of the rotor shaft to releasably engage the rotor shaft end and impart rotational drive to the shaft or, particularly, lock its movement. The present device preferably contributes minimally to the overall weight of the crusher during transportation and installation by being demountably connectable to an external region of the crusher frame via at least one releasable mounting. However, it is envisaged that the device would be semi-permanent once installed, albeit removable when the need arises.

A device according to the invention attaches to an external region of the crusher frame such that a shaft engager of the device is positionable coaxially with the rotor shaft and can be affixed to a shaft bearing in any position for locking the rotor shaft, should a blockage arise. In a preferred form the locking aspect of the invention is combined with other positioning features to provide a complete external system for positioning and locking of a crusher rotor shaft.

In the combined positioning/locking system a rod is provided which actuates the shaft engager. Moreover, a drive component of the device is configured to impart rotation of the shaft via the rod and an intermediate shaft engager provided at one end of the rod. The present device avoids the need for personnel to access the crushing chamber when changing rotor hammers or the curtain setting which typically involves rotation of the rotor to a desired orientation.

With regard to the locking aspect of the invention, the shaft engager of the device includes a portion that overlaps with a bearing/housing of the rotor shaft and is fixable thereto in order to lock the rotor shaft in place and prevent its rotation during maintenance. In connection with this feature, the shaft engager preferably includes a multi-toothed wheel for mating within (or without) a corresponding multi-toothed wheel affixed coaxially with the rotor shaft. This enables many degrees of movement in order to align bolt holes in the overlapping portion of the shaft engager with corresponding holes in the rotor shaft bearing;

at least when a closest rotational mating position is chosen for alignment, thereby enabling any rotational position of the rotor shaft to be locked A further advantageous feature of the device is to provide an alignable indicator, i.e. in the form of markings or openings on a surface of the shaft engager for alignment to markings made on the non-driven end of the rotor shaft (or upon a mating multi-toothed wheel fixed on the rotor shaft as mentioned above). Such a feature enables the position of the hammers within the crusher to be known from the perspective of external maintenance personnel in order to easily achieve a top-dead centre position for a hammer. A preferred embodiment of alignable indicator is a slot or like aperture formed through the shaft engager such that a marking upon the rotor shaft end is visible.

According to a first aspect of the present invention there is provided a rotor locking device to lock any rotational position of a rotor shaft, e.g. of a horizontal shaft impact crusher, the locking device comprising: a shaft engager including a mating element, engageable with a corresponding mating element at an end of the rotor shaft, the mating element having multiple degrees of movement freedom to mate and become rotationally interdependent with the rotor shaft, further including an overlap portion that, in use, overlaps with a bearing mount surrounding the rotor shaft and is capable of being fastened thereto so as to rotationally lock the rotor shaft and shaft engager.

Preferably, the overlap portion includes apertures that align with fixing points on the bearing mount, said apertures being sized larger than the fixing points to account for at least one degree of movement of the relative mating elements. In the preferred embodiment the apertures in the overlap portion are circumferential slots that provide a degree of rotational play to align with threaded holes present on the bearing mount of the machine.

In one form, the device further comprises a rod to actuate axial positioning of the shaft engager and a bearing assembly mounting the rod with a frame. The bearing assembly allows the rod to slide axially relative to the frame and to move the engager to and from contact with the shaft of the rotor. The bearing assembly may comprise a single or multiple bearing assemblies mounted at different axial positions relative to the rod. Preferably, the bearing assembly is mounted within a drive transmission assembly or gearbox supported at the mainframe and is substantially stationary relative to the frame so as to support the axial sliding and rotational movement of the rod.

Preferably, a second end of the rod projects rearwardly beyond the frame so as to be exposed relative to a second side of the frame, the shaft engager extending from a first side of the frame. Such an arrangement is advantageous to allow personnel to grasp the rod to actuate the axial sliding movement by pushing and pulling the engager towards and away from contact with the rotor shaft end. Also, in a preferred embodiment, the second exposed end of the rod is engageable with a rod positioner that defines and maintains an engaged and/or disengaged position of the rod, via the shaft engager, with the rotor shaft. The rod positioner may be in the form of a spring-biased protrusion that is received by an annular recess formed around the rod.

The shaft engager comprises a disk and a plurality of keying elements projecting from the disk, configured to be mated with an end of the shaft of the rotor and which provide many degrees of rotational engagement. Preferably, this feature is embodied by a multi-toothed configuration, e.g. where the disk of the shaft engager has a female multi-toothed recess that is coaxially engageable with a male multi-toothed part located coaxially with the rotor shaft or vis-versa. The male part has the appearance of a gear wheel and the female part is a like-dimensioned ring/disk with an internal toothed pattern to fit over the male part to result in rotational interdependence.

A multi-toothed solution is preferable due to the many degrees of movement (defined by the number of teeth) it provides where the shaft engager can be engaged with the rotor shaft and the overlapping portion bolted into place at any rotational position of the rotor shaft. To facilitate this feature, as mentioned, the overlapping portion preferably includes openings/apertures in the form of circumferentially elongated slots of a length that corresponds to at least one pitch in the gear wheels.

Preferably the device further comprises a gearbox, with a crank handle rotatably coupled to drive rotation of the rod via the gearbox. Preferably, the gearbox is a reduction gearbox. Optionally, the gearbox comprises an overall gear ratio of 20:1. The gearbox may comprise any form of power transmission system operative between the drive component and the rod.

Optionally, the crank is detachably mounted at the gearbox via a mounting boss provided at one end of an axel to facilitate transportation and storage of a device between operation. Alternatively, the drive component may comprise an electric, hydraulic or pneumatic motor mounted at or remote from the positioning device. The motor may be controlled locally or remotely via wired or wireless communications and suitable electronic control implementing control software.

According to a second aspect of the present invention there is provided a crusher including a rotor positioning and the locking device as described herein.

In a preferred but optional form of the device according to the invention the device functions as a rotor positioning and locking device for adjusting a rotational position of a rotor shaft, e.g. of a horizontal shaft impact crusher, the device further comprising: a frame; a rod rotatably mounted at the frame; the shaft engager provided at one end of the rod to engage, in use, an end of the rotor shaft so as to rotatably interconnect the rod and the shaft; the shaft engager being adjustably mounted relative to at least a part of the frame to enable the engager to move to and from contact with the rotor shaft; a drive component coupled to the rod to rotate the engager and impart rotational drive to the shaft of the rotor; and wherein the shaft engager includes an alignable indicator for alignment with a marking upon the rotor shaft.

In a preferred embodiment the alignable indicator is a slot or like aperture formed through the shaft engager such that a marking upon the rotor shaft end is visible, thereby revealing a position of the rotor.

According to a further aspect of the present invention there is provided a method of locking a rotor shaft. The method comprises the steps of: moving a shaft engager into engaging contact with an exposed end face of the rotor shaft, the shaft engager and the end face having mating parts that enable multiple degrees of relative rotational movement for engagement, fastening the shaft engager to a bearing mount of the rotor shaft via through holes that are alignable with fixing points on the bearing mount, typically in the form of threaded bolt holes.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
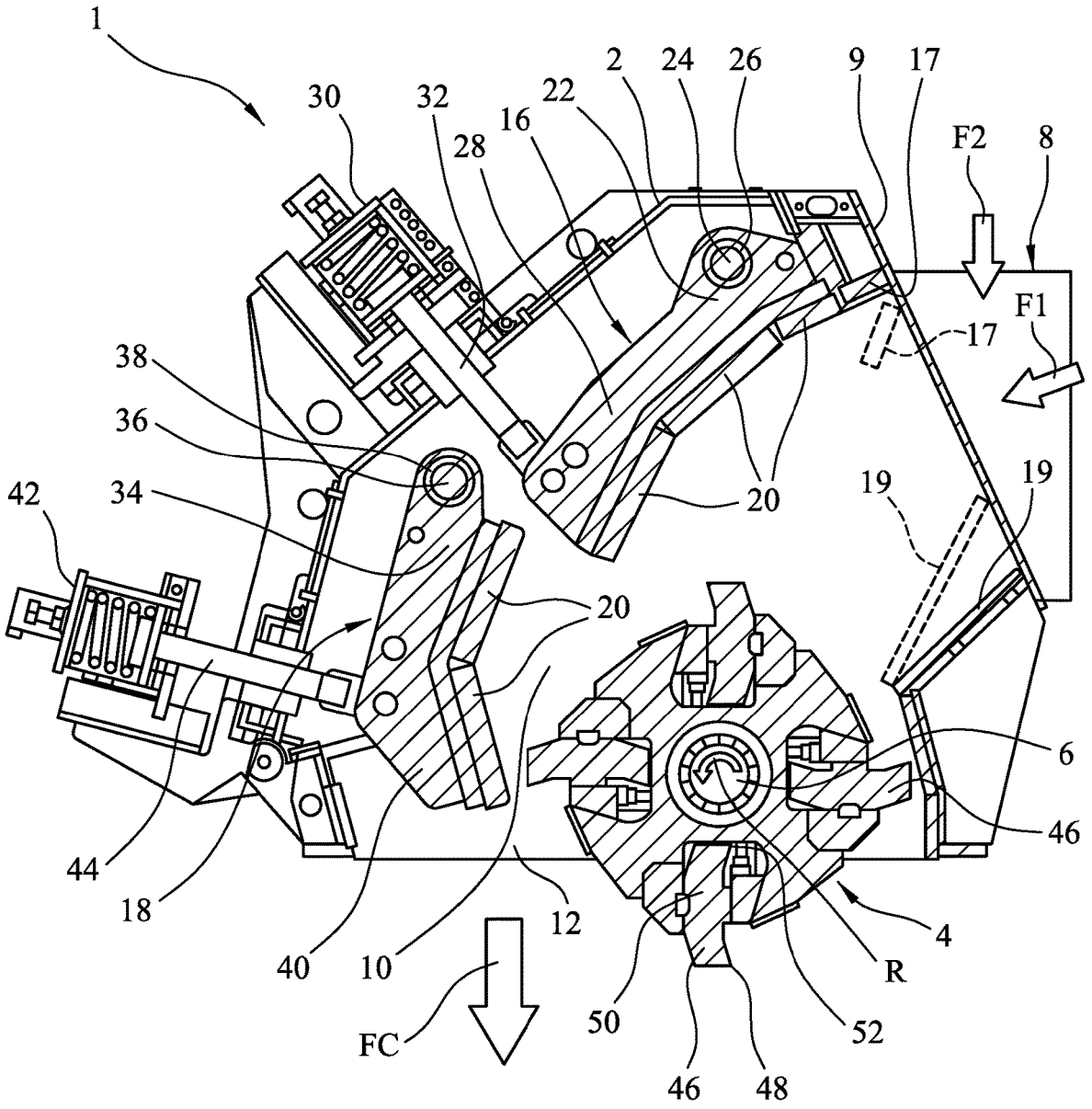
FIG. 1 illustrates a cross-sectional side view of a horizontal shaft impact crusher comprising an internally mounted rotor mounted on a rotor shaft that carries a plurality of replaceable hammer elements according to a specific implementation of the present invention.

Referring to FIG. 1 a horizontal shaft impact crusher 1 (HSi crusher) comprises a housing 2 in which an impeller indicated generally by reference numeral 4 is rotatably mounted. A motor (not illustrated) is operative for rotating a horizontal shaft 6 on which the impeller 4 is mounted. As an alternative to impeller 4 being fixed to shaft 6, impeller 4 may rotate around shaft 6. In either case, impeller 4 is operative for rotating around a horizontal axis, coaxial with the centre of shaft 6.

Material to be crushed is fed to a feed chute 8, which is mounted to an inlet flange 9 of housing 2, and enters a crushing chamber 10 positioned inside the housing 2 and at least partly enclosing impeller 4. Material crushed within the crusher 1 exits the crushing chamber 10 via a crushed material outlet 12.

Crusher 1 comprises a first curtain 16, and a second curtain 18 arranged inside crushing chamber 10. Each curtain 16, 18 comprises at least one wear plate 20 against which material may be crushed. A first end 22 of first curtain 16 is mounted via a horizontal first pivot shaft 24 extending through an opening 26 formed in curtain 16 at the first end 22. First pivot shaft 24 extends further through openings in the housing 2 to suspend the first end 22 in the housing 2. A second end 28 of first curtain 16 is connected to a first adjustment device 30 comprising at least one adjustment bar 32. A first end 34 of second curtain 18 is mounted by means of a horizontal second pivot shaft 36 extending through an opening 38 formed in curtain 18 at first end 34. Second pivot shaft 36 extends further through openings in the housing 2 to suspend the first end 34 in the housing 2. A second end 40 of second curtain 18 is similarly connected to a second adjustment device 42 comprising at least one adjustment bar 44.

Impeller 4 is provided with four hammer elements 46 in this embodiment, although the number of hammers tends to increase with the overall size/capacity of the machine. Each of elements 46 has a generally curved shape profile, when view in cross-section. An arrow R indicates the rotational direction of impeller 4. A leading edge 48 of each respective hammer element 46 extends in the direction of rotation R. Prior to extended use, hammer element 46 is symmetric around a central portion 50. However, once leading edge 48 has been worn element 46 can be turned and mounted with its second leading edge 52 operative for crushing material.

The HSi crusher 1 can be adjusted to a first crushing setting, which for example may be a primary crushing setting, for crushing large objects (typically having a maximum particle size of 300-1200 mm), and a second (or secondary) crushing setting being different from the first setting for crushing intermediate size objects (having a maximum particle size of less than 400 mm and typically 20-400 mm). When crusher 1 is operated in the primary setting the crushed material exiting crusher 1 via the outlet 12 would typically have an average particle size of 35-300 mm, and typically at least 75% by weight of the crushed material would have a particle size of 20 mm or larger. When crusher 1 is operated in the secondary setting the crushed material leaving the crusher 1 via the outlet 12 would typically have an average particle size of 5 to 100 mm, and typically at least 75% by weight of the crushed material would have a particle size of 5 mm or larger. Within the present specification the 'average particle size' refers to weight based average particle size.

Adjusting crusher 1 to the primary crushing setting would typically involve retracting the first and/or second curtains 16, 18 away from impeller 4, to form a crushing chamber 10 having a large volume and a large distance between the impeller 4 and the wear plates 20 of curtains 16, 18. Such retraction of at least one curtain 16, 18 would be performed by operating the first and/or second adjustment devices 30, 42, which may typically involve hydraulic cylinders and/or mechanical adjustment devices using threaded bars. Adjusting the crusher 1 to the secondary crushing setting would, on the other hand, typically involve moving the first and/or second curtains 16, 18 towards the impeller 4 by means of operating the first and/or second adjustment devices 30, 42, to create a crushing chamber 10 having a small volume and a short distance between the impeller 4 and the wear curtain plates 20. In addition to adjusting the position of the curtains 16, 18, the horizontal shaft impact crusher feed chute 8 is adjusted to feed the material into the crushing chamber 10 in a first direction F1 when crusher 1 is adjusted to the primary setting, and in a second direction F2 when crusher 1 is adjusted to the secondary setting. Hence, the first crushing setting is different from the second crushing setting. Furthermore, the first direction F1 of feeding material to the crusher 1 is different from the second direction F2 of feeding material to the crusher 1.

The adjustment of the HSi crusher 1 from a primary crushing setting to a secondary crushing setting may also involve adjusting the positions of an upper feed plate 17 and a lower feed plate 19 that are located just inside of the inlet flange 9 of the housing 2 of the crusher 1. The feed plates 17, 19 protect the inlet of the housing 2, and provide the material fed to housing 2 with a desired direction. In FIG. 1, the upper and lower feed plates 17, 19 are adjusted to the primary setting (shown in unbroken lines) with the intention of directing the coarse material towards impeller 4 and the first curtain 16 when the crusher 1 operates in the primary setting. The positions of the upper and lower feed plates 17, 19 in the secondary setting are indicated with broken lines in FIG. 1. As can be seen the upper and lower feed plates 17, 19 are, in the secondary setting, arranged for directing the material directly towards the impeller 4. In this manner, the rather fine material fed when the crusher 1 operates in the secondary setting will receive more 'hits' from the impeller hammer elements 46 leading to a greater reduction in the size of the material.

In operation, material to be crushed is fed to the feed chute 8 and further into the crushing chamber 10, either in the direction F1 if the crusher 1 is adjusted to the primary setting or in the direction F2 if crusher 1 is adjusted to the secondary setting. The material will first reach that part of the crushing chamber 10 which is located adjacent to first curtain 16, being located upstream of the second curtain 18 as seen with respect to the direction of travel of the material. Impeller 4 is rotated at typically 400-850 rpm. When the material is impacted by the impeller elements 46 it will be crushed and accelerated against wear plates 20 of first curtain 16 where subsequent and further crushing occurs. The material will bounce back from first curtain 16 and will be crushed further against material travelling in the opposite direction and then again against the elements 46. When the material has been crushed to a sufficiently small size it will move further down the crushing chamber 10, and will be accelerated, by means of the elements 46, towards wear plates 20 of the second curtain 18, being located downstream of first curtain 16. When the material has been crushed to a sufficiently small size it exits chamber 10 via outlet 12 as a flow of crushed material FC.

In accordance with the invention and with reference to FIGS. 2 to 11, a rotor positioning device 113 is configured to be mounted at an external side of the crusher and, particularly, to a bearing mount 200 which supports a non-driven end of rotor shaft 6. Positioning device 113 comprises a frame indicated generally by reference 100. Frame 100 comprises a bracket-like body aligned to be generally horizontal when device 113 is mounted in position adjacent the end of rotor shaft 6 as illustrated. Frame 100 includes an aperture 114 through which a drive rod 104 extends and intended to be orientated substantially horizontally and coaxial with rotor shaft 6. Frame 100 further comprises a bracket mount part 110 configured for attachment to an exposed face of bearing 200. Attachment is intended to be by use of bolts 111 that enable removability, although in practice it is expected that the positioning/locking device would be assembled and left in place permanently on the crusher.

Figure 2:
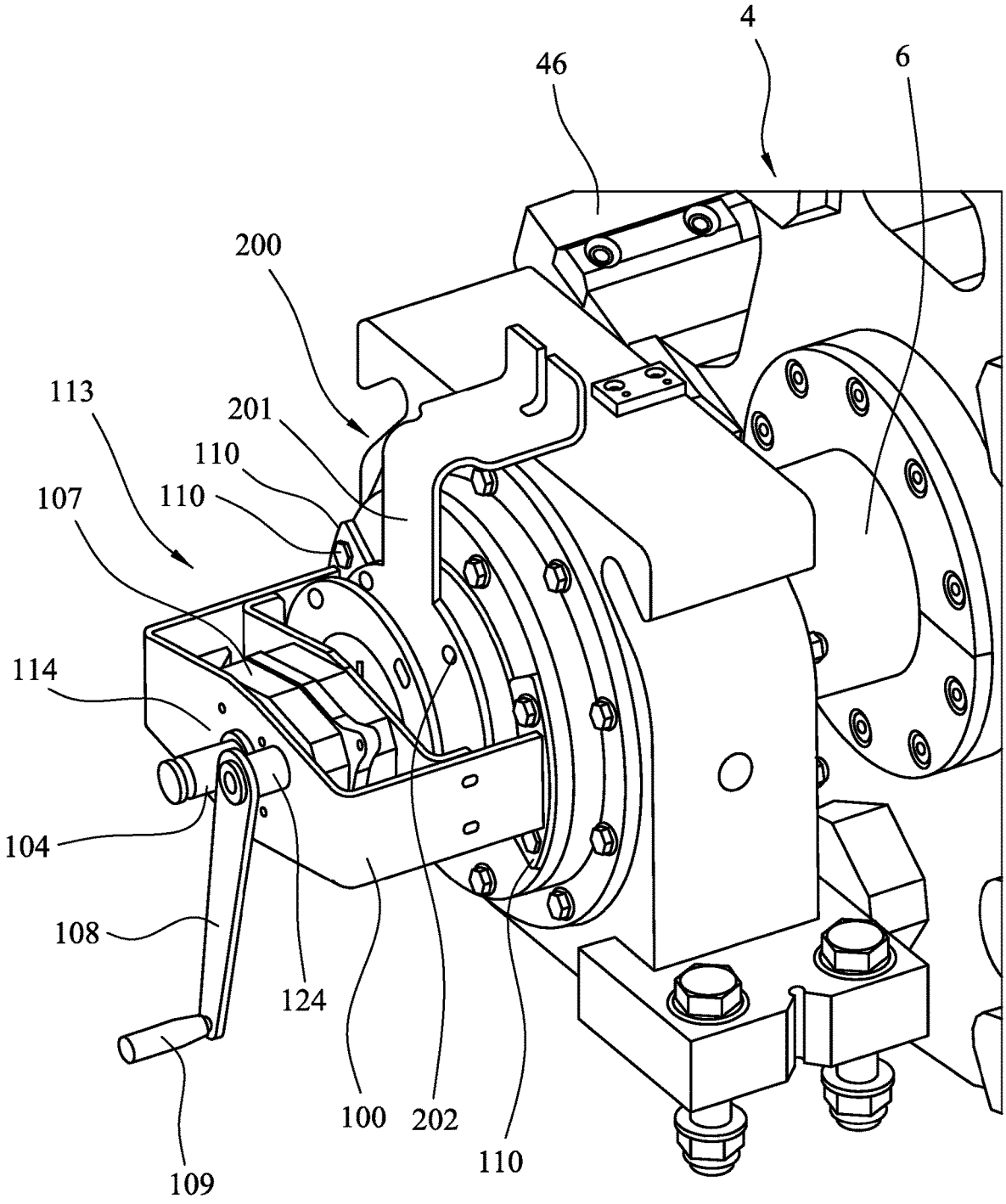
FIG. 2 illustrates a perspective view of a rotor positioning and locking device mountable to an external side of the crusher of FIG. 1 according to a specific implementation of the present invention.
Figure 3:
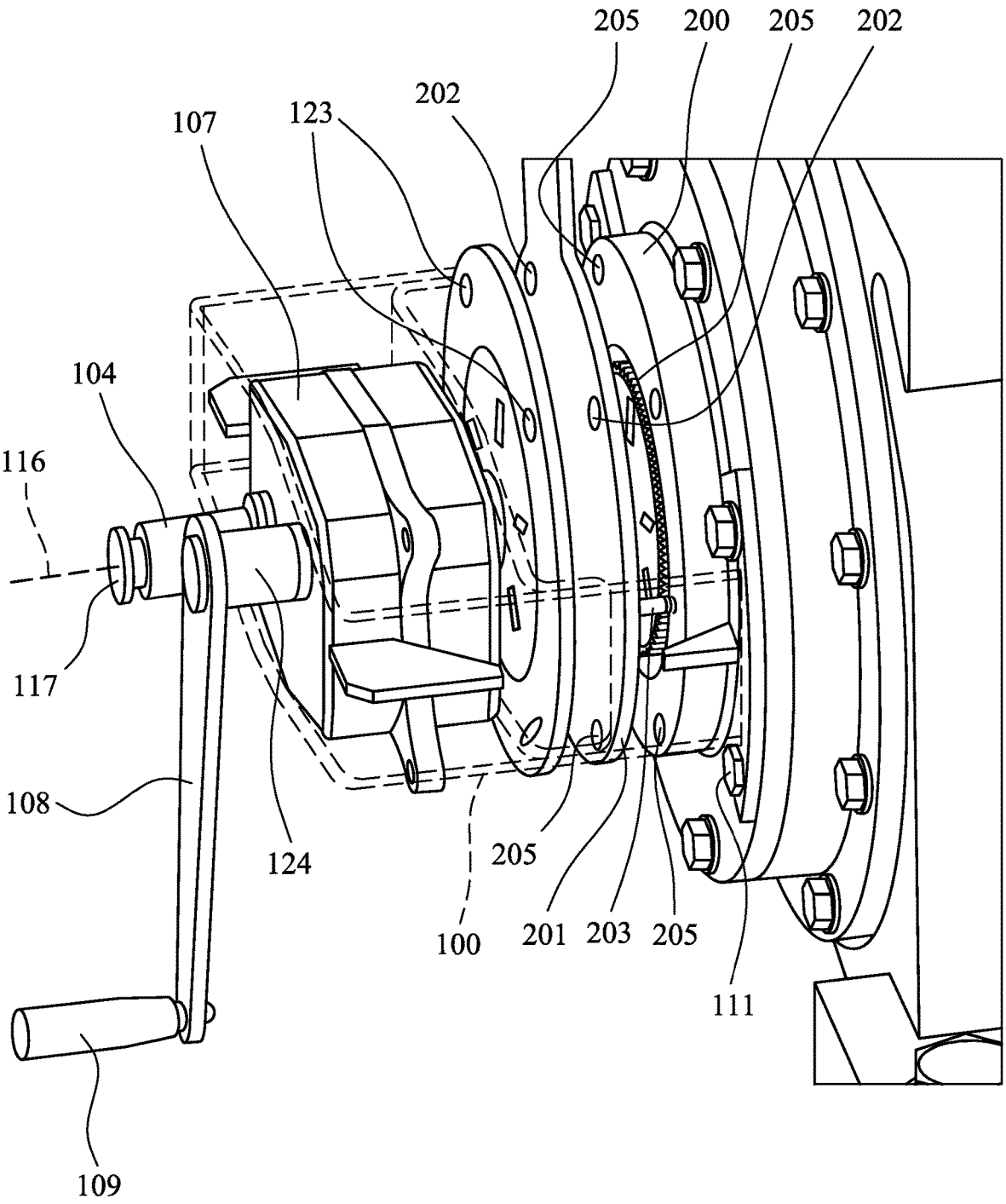
FIGS. 3 to 9 illustrate further perspective views of the positioning and locking device from FIG. 2, during various stages and implementation and use.
Figure 4:
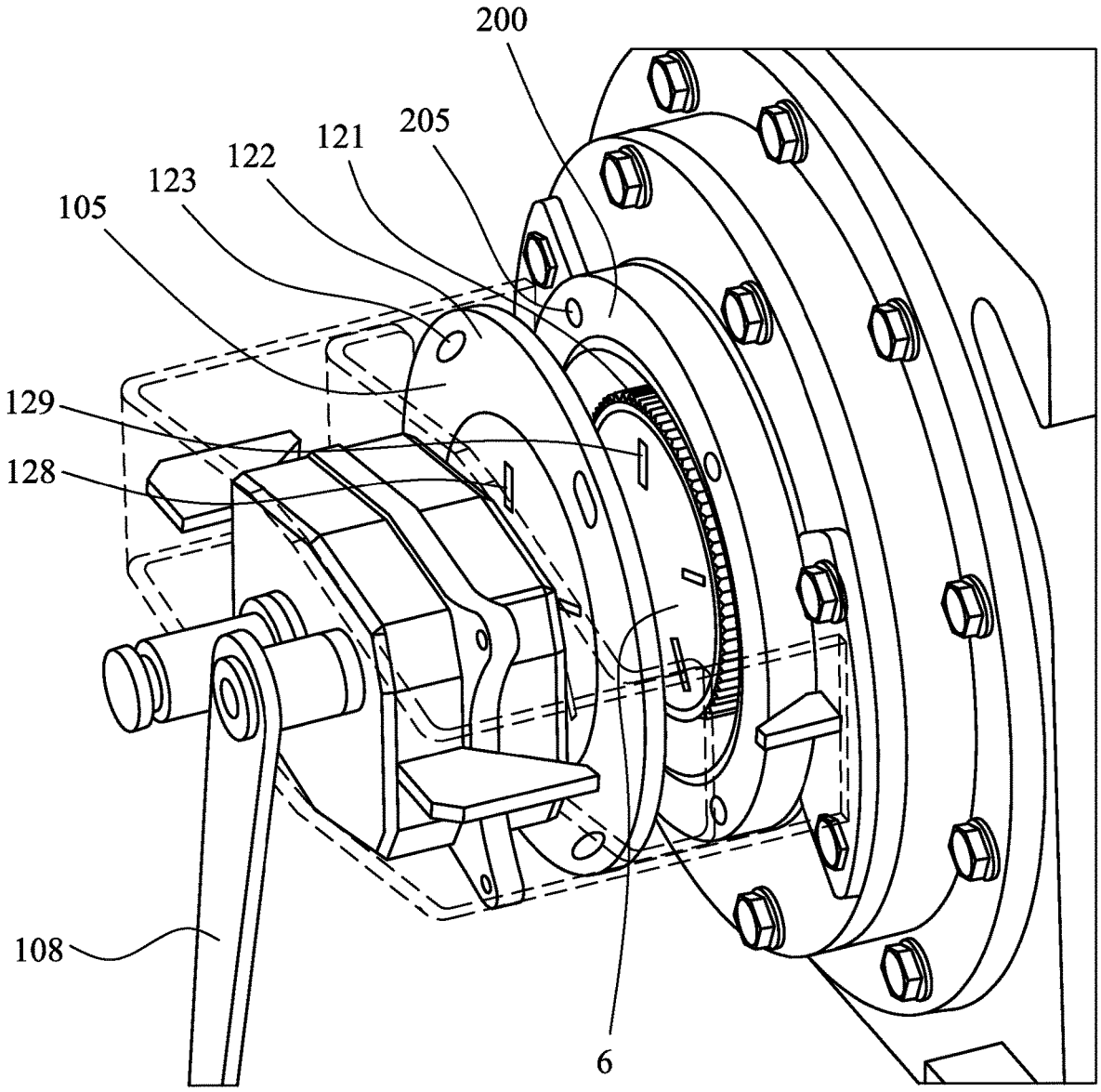

During normal use of the crusher the exposed end of rotor shaft 6 is covered by an end plate 201 which is bolted to a face of bearing 200. FIG. 2 shows bolts already removed from bolt holes 202 (aligning for fastening with receiving holes 205 on bearing 200) and FIG. 3 shows end plate 201 in a retracted position relative to bearing mount 200, ready to be removed entirely and for maintenance to begin. In practice, end plate 201 is located with the use of a dowel pin 203, thus ensuring it is fitted in a correct orientation.

A gearbox 107 is mounted within frame 100 and internally engaged with rod 104 passing therethrough. Gearbox 107 drives rotation of rod 104 by use of a manual crank handle 108 that, when engaged with rotor shaft 6 as will be described below, also causes rotation of the rotor 4 within the crusher. A bearing assembly within gearbox 107 is configured to allow rod 104 to rotate about its longitudinal axis 116 and also to enable rod 104 to slide axially (along axis 116) relative to frame 100 and gearbox 107.

Rod 104 comprises a first end projecting axially forward from gearbox 107 (mostly obscured in the figures) and a second end 117 projecting axially rearward from frame 100. The sliding of rod 104 within gearbox 107 is actuated by personnel pushing and pulling rod end 117 relative to frame part 100 either manually or with a suitable gripping tool.

Figure 5:
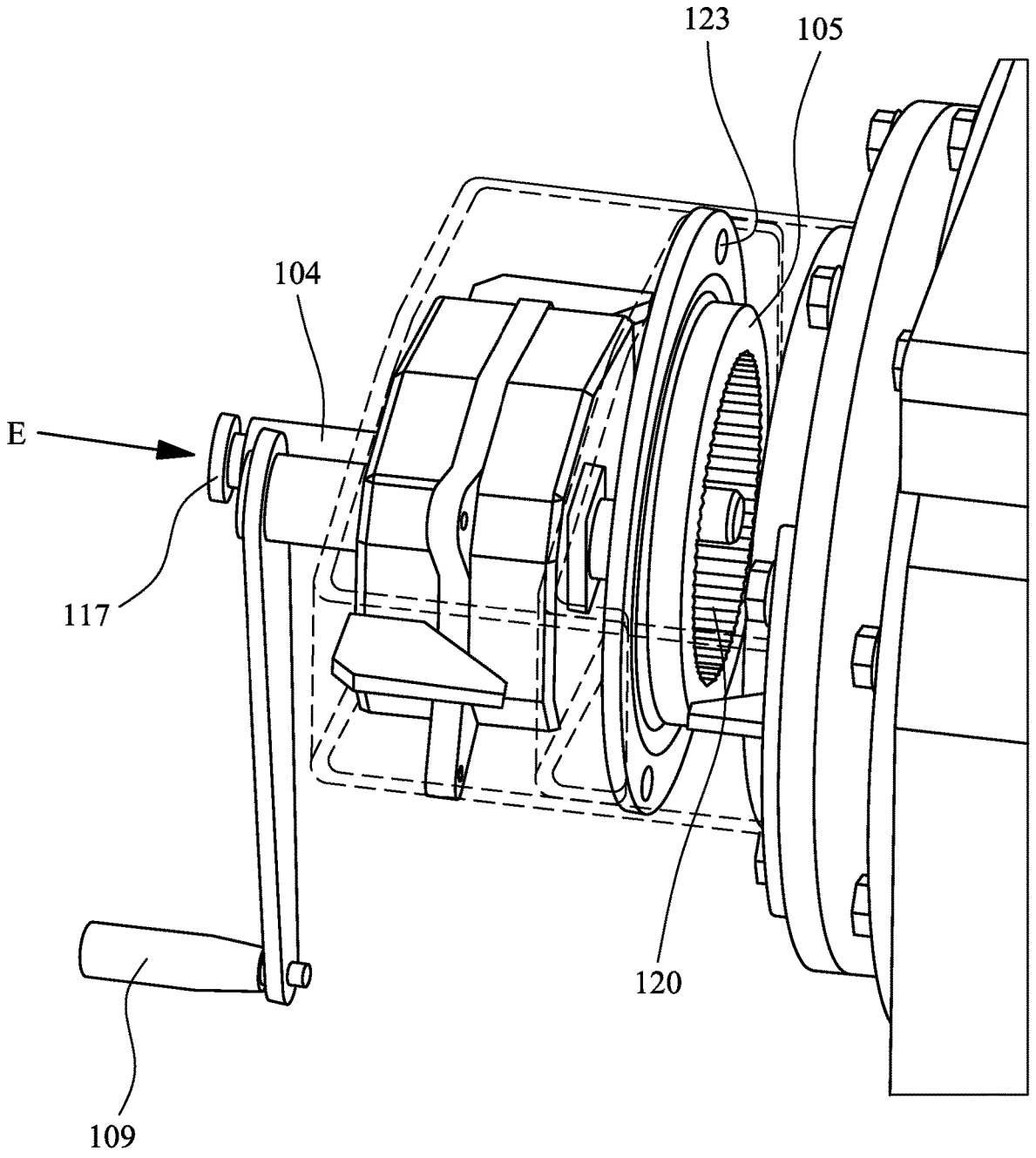

A shaft engager 105, rigidly and coaxially mounted from the first end of rod 104, is comprised of a circular disk. As best seen in FIG. 5 and the dotted detail of FIGS. 6 and 7, the rotor shaft-facing side of shaft engager 105 includes a female mating part 120 comprised of a multiple toothed annular surface. Female mating part 120 is adapted to receive a corresponding male part 121 in the form of a wheel, also with a multiple toothed annular surface, that is affixed to the exposed end of rotor shaft 6. Accordingly, when rod 104 slides in the direction of arrow E, through gearbox 107, shaft engager 105 engages the exposed end of rotor shaft 6; i.e. a gear wheel, and becomes rotationally interdependent therewith by virtue of the meshing male and female toothed surfaces 120 and 121.

An alternative keyed arrangement could be utilised, however, the illustrated embodiment with intermeshing multiple teeth in female and male mating parts allows for a high degree of relative rotational engagement positions between shaft engager 105 and the end of rotor shaft 6. The number of engagement positions corresponds to the number of intermeshing teeth of the female and male mating parts 120/121. A pitch distance between adjacent teeth defines the minimum relative rotational movement.

In the event that the crusher becomes blocked and rotor shaft 6 is prevented from further rotational movement, it is desirable that the rotor can be locked in the ceased position so that work can be carried out to clear the blockage. The present invention provides a mechanism for locking the rotor shaft, in whatever position it is ceased, from outside the crusher before access hatches are opened to expose personnel to dangers within the crusher.

As already described, shaft engager 105 is comprised of a circular disk which is configured to cover the end of rotor shaft 6 during maintenance operations. It also extends to overlap and cover the exposed face of bearing mount 200 which supports around the non-driven end of rotor shaft 6. The overlapping rim portion 122 of engager 105 overlaps with the fixing holes 205 that, during normal use, secure end plate 201 in place. When end plate 201 is removed (as in FIGS. 4 and 5) the fixing holes 205 become available to use as a fastening point for shaft engager 105 by alignment with engager holes 123 located at the peripheral edge thereof.

In order to engage and lock shaft engager 105 with rotor shaft 6 in a ceased position the disk of the engager is simply turned on its axis 116 until holes 123 are generally aligned with fixing holes 205 and then engager 105 is moved forward to mate the meshing teeth of female and male parts 120/121. However, since the rotor can cease in any unpredictable position it is probable that alignment of the holes 123/205 will not be perfect and, therefore, engager holes 123 are formed with an elongation in the circumferential direction (relative to rim portion 122) to account for any misalignment. The degree of elongation preferably corresponds to at least one pitch of a tooth of the mating parts 120/121 because this will account for any fractional difference in the alignment.

Alternative forms of the invention could feature circumferential slots formed into bearing mount 200 that receive dowel pins extending forward from the shaft engager rim portion 122. In this way, the invention anticipates alternative constructions that achieve the same result, i.e. a capability to rotationally lock the rotor shaft in any position from outside the crusher.

Figure 7:
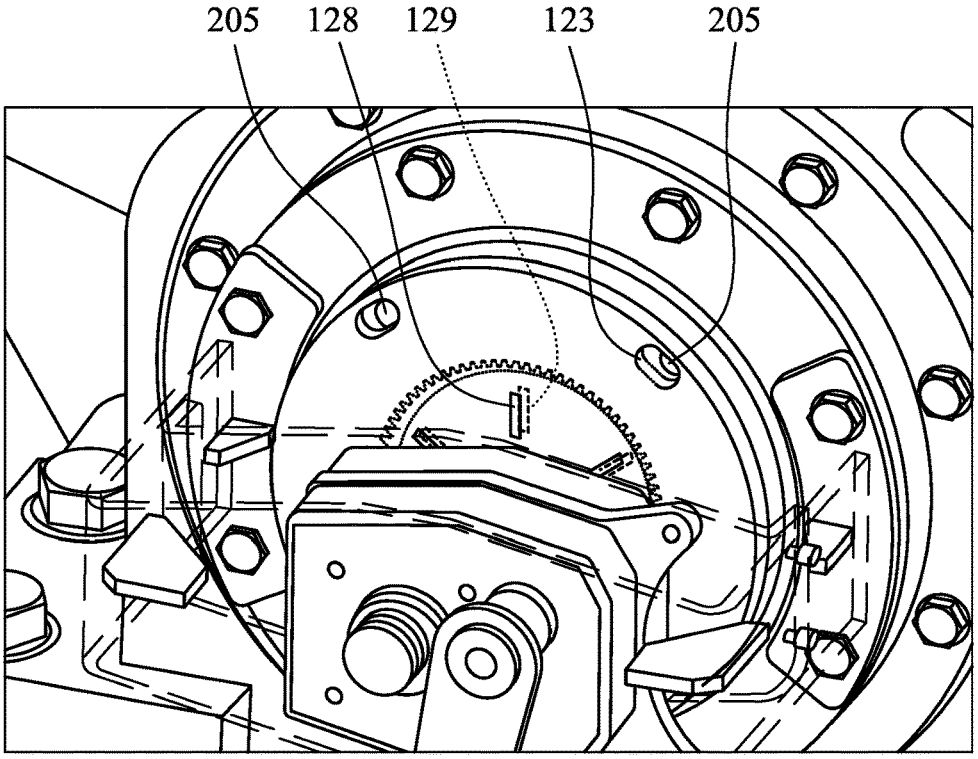

In the preferred embodiment, alignment of holes 123/205 is best illustrated by FIG. 7. When all holes 205 on the bearing 200 are visible through the slotted/widened engager holes 123, bolts 130 can be fitted and tightened to fasten engager 105 in place (FIG. 9) and, by virtue of the intermeshing teeth 120/121 the rotor is locked in any position.

The foregoing describes use of the device as a locking mechanism, particularly when there is a blockage preventing free rotation of the rotor shaft 6. However, in normal circumstances when there is no blockage but some form of maintenance is required, the device is also configured for use as a positioning mechanism. In such use, the rotor can be manually adjusted to any position, from a location of safety outside the crusher chamber.

Due to the rigid coupling of disk 105 at rod 104, a rotation of rod 104 provides a corresponding rotation of the female mating part 120 about axis 116. Accordingly, positioning device 113 further comprises a drive component configured to actuate rotational drive of rod 104 and, in turn, the mating parts 120/121 when engaged.

According to the specific implementation, the drive component comprises a crank handle formed from a crank arm 108 that provides a radial connection between a handle 109 (provided at one end of arm 108) and a mounting boss 124 (provided at a second end of arm 108). Boss 124 is rigidly mounted at a drive shaft rotationally coupled to gearbox 107 such that rotation of the shaft inside boss 124 through the internal gears of gearbox 107 provides a corresponding rotation of rod 104 about axis 116. According to the specific implementation, gearbox 107 is a reduction configuration comprising a reduction ratio of, e.g. 20:1. The precise control of the rotational position of female part 120 is achievable by rotation of crank handle 109. As will appreciated, gearbox 107 may comprise any internal gear configuration.

Figure 11:
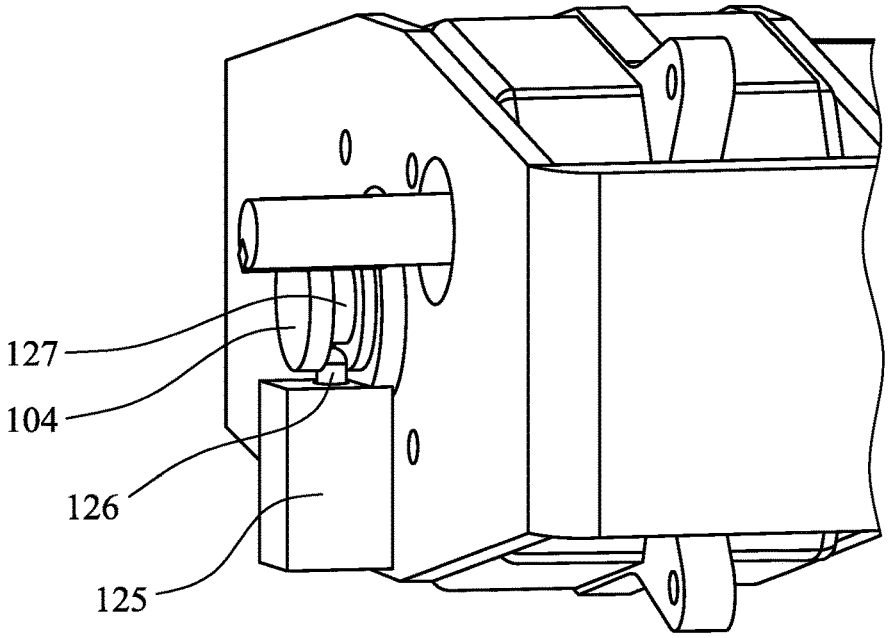

When shaft engager 105 is in an extended position via rod 104 it is preferable that female and male mating parts 120/121 are held in engagement such that rotational interdependence of shaft engager 105 and rotor shaft 6 is assured and could not slip apart. To address this, referring to FIGS. 10 and 11, the second exposed end of the rod 104 is engageable with a rod positioner 125 that defines and maintains an engaged and/or disengaged position of the rod 104, via the shaft engager 105, with the rotor shaft 6. The rod positioner 125 may be in the form of a spring-biased protrusion 126 that is received by an annular recess 127 formed around the rod 104. Particularly, FIG. 11 shows how a protrusion 126 extends into annular recess 127 and thereby prevents rod 104 from moving in the axial direction 116. Pin protrusion 126 can be withdrawn by a suitable means to free rod 104 to move once again, such that shaft engager 105 could be disengaged from the end of rotor shaft 6 after maintenance is completed.

Figure 8:
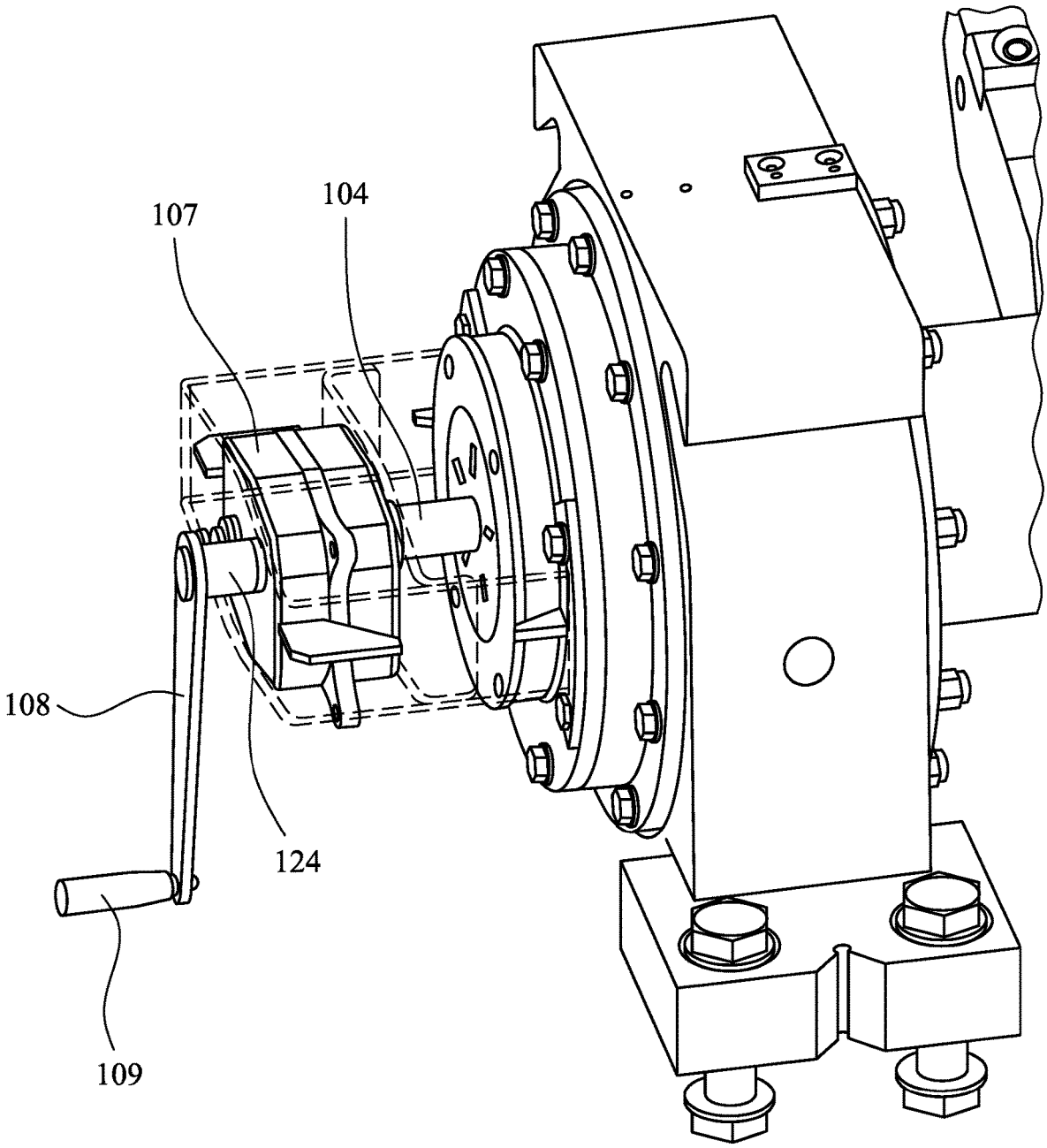
Figure 9:
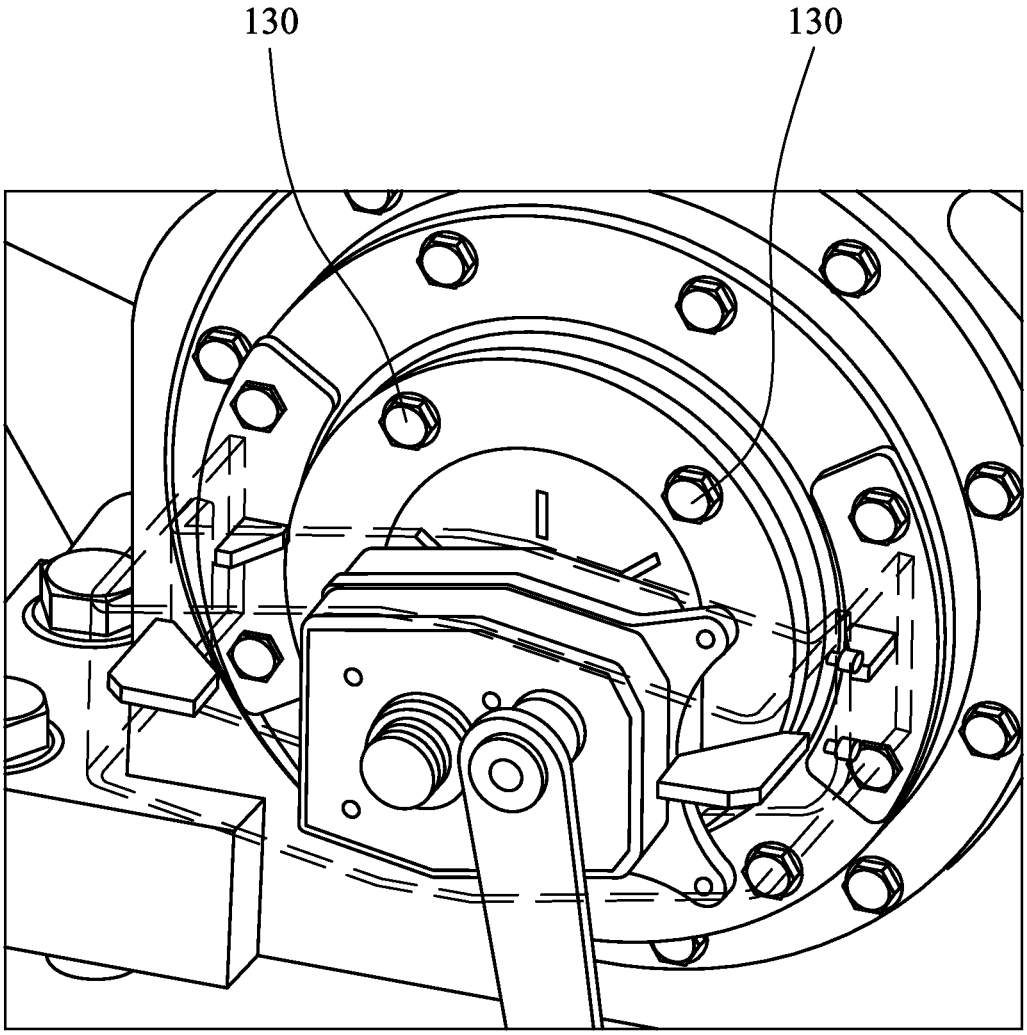
Figure 10:
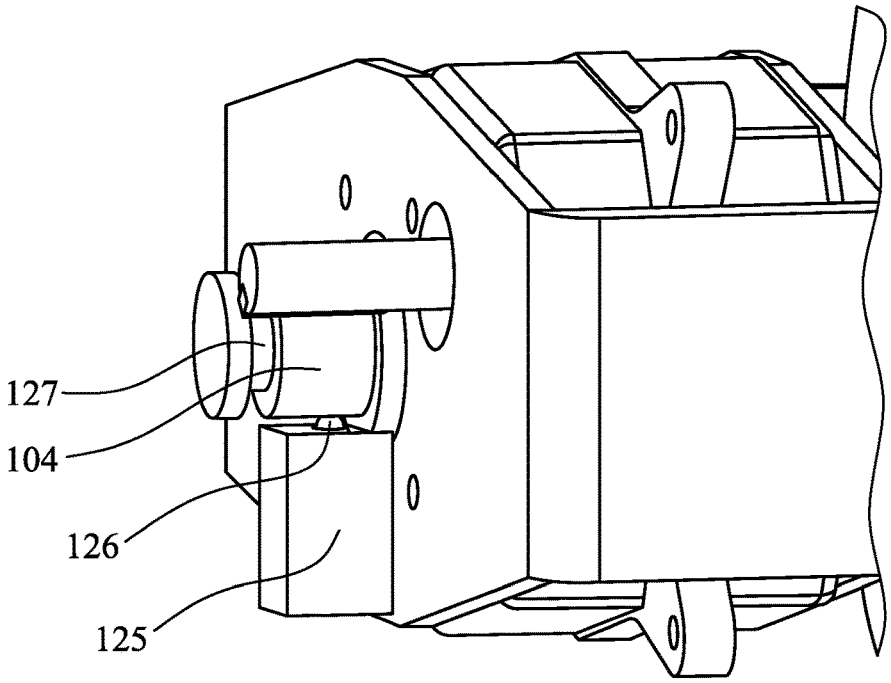
FIGS. 10 and 11 illustrate perspective views of a rod positioner mounted with a frame of the positioning and locking device of the invention.

Referring to the overview of FIG. 8, rotation of rotor shaft 6 is achieved by service personnel grasping and turning handle 109 that drives rotation of rod 104 and accordingly the mated parts 120/121. Device 113 therefore provides fine rotational adjustment of hammer elements 46 relative to the curtain plates and in particular a lower 'toe' region of curtains 16, 18. That is, device 113 provides an externally mounted drive apparatus to move hammer elements 46 relative to the curtains.

The present adjustment device 113 also greatly facilitates maintenance and interchange of worn hammer elements 46 by proving the convenient and reliable adjustment of the rotational position of each hammer element 46 to a top dead-centre position within chamber 10. Service personnel can then access the uppermost row of hammer elements 46 by opening the crusher pivot frame. The exact location of hammer elements 46 on the rotor 4, in particular corresponding to top dead-centre, can be divined by use of an alignment indicator means. In this way a rotor can be positioned in any orientation before the crusher chamber is opened for manual access and servicing.

Figure 6:
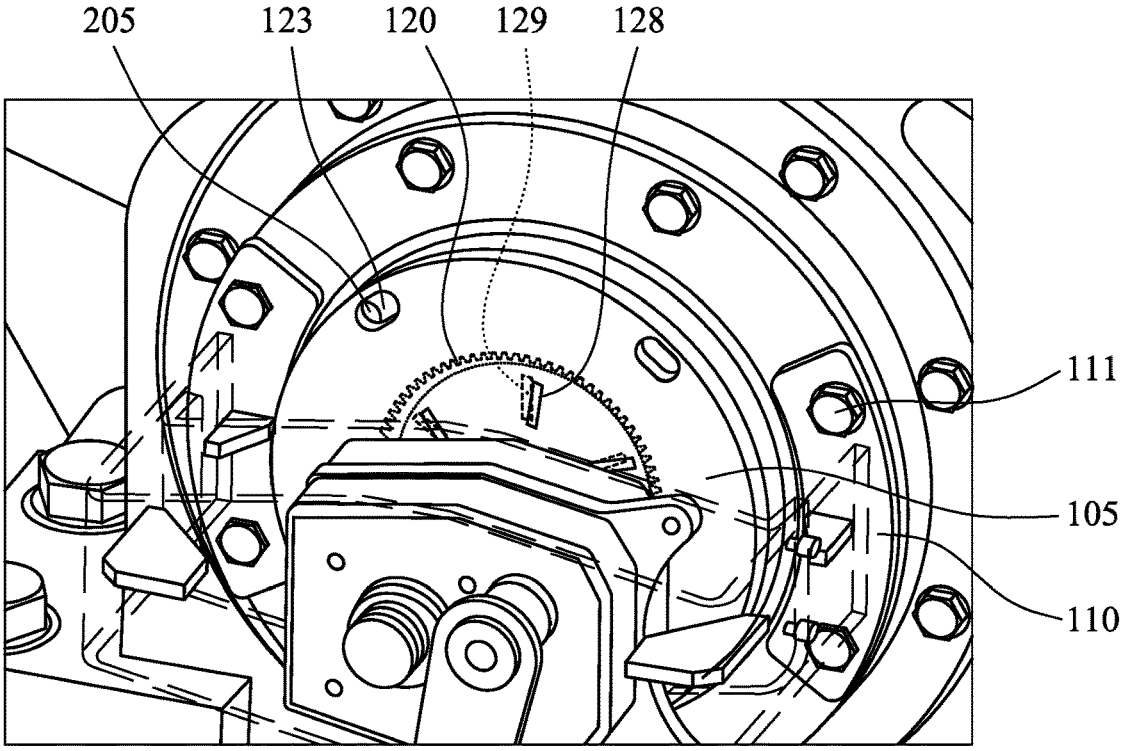

Referring especially to FIGS. 6 and 7, an alignable indicator system is shown, e.g. in the form of markings or openings 128 on the visible outer surface of the shaft engager 105 for alignment to markings 129 made on the non-driven end of the rotor shaft 6 (or upon a mating multi-toothed wheel fixed on the rotor shaft as detailed above). Such a feature enables the position of the hammers 46 within the crusher to be determined from the perspective of external maintenance personnel in order to easily achieve a top-dead centre position for a hammer. As illustrated, a preferred embodiment of alignable indicator is a slot or like aperture 128 formed through the shaft engager 105 such that a marking 129 upon the rotor shaft end 6 is visible.

In practice, the markings 128 of the shaft engager 105 are moved into alignment (by turning drive handle 109) with the markings 129 of the rotor shaft 6 before the mating parts 120/121 are finally engaged. Once engaged (held in place by rod positioner 125) movement of crank handle 109 will turn rotor 4 within the crusher.

In the illustrated form of the invention there are five slots/markings 128 upon the shaft engager disk 105 that are alignable with markings 129 upon the rotor shaft 6. These correspond to the position of five hammers within the crusher. Clearly, in crusher designs that have more or less hammers, a corresponding number of markings 128/129 can be formed. Indeed, alternative configurations of markings (including intermediate positions) may be provided if deemed useful for a particular maintenance purpose.

As will be appreciated, the present positioning device 113 is compatible for use with existing HSi crushers via releasable or permanent mounting to the region adjacent the non-driven end of rotor shaft 6 being external to the internal components of chamber 10 and the drive and gear components of crusher 1 configured to provide rotational drive of impeller 4. Once the curtain setting and/or the interchange of hammer elements 46 is complete, device 113 may be optionally demounted from crusher 1 and the shaft end plate 201 repositioned to conceal shaft end face 6. The present positioning device 113 is also compatible for use with crushers 1 having safety interlock mechanisms that encompass the safety locking and release of the shaft end plate. In such systems the tools for removal of the end plate 201 are not released until the rotor has stopped moving.

According to further specific implementations, positioning device 113 may additionally or alternatively comprise a powered motor to drive rotation of rod 104. Such a drive motor may be operated locally at frame 100 or remotely via wired or wireless electronic communications and electronic control. It will be apparent that the locking feature and, separately, alignable indicator aspects of the invention are not dependent on the particular drive means applied to the shaft engager.

The invention claimed is:

1. A rotor locking device for locking a rotational position of a rotor shaft in a crusher, the locking device comprising:

a shaft engager including a first mating surface arranged for coaxial engagement with a second mating surface located at an end of the rotor shaft, the first mating surface having a plurality of rotational mating positions with the second mating surface, wherein when in at least one of the rotational mating positions the first and second mating surfaces are rotationally interlocked; and a fastening portion extending radially outward at the shaft engager arranged to overlap a bearing mount surrounding the rotor shaft and being fastenable therewith.

2. The rotor locking device of claim 1, wherein the fastening portion includes engager apertures alignable with fastening points in the bearing mount, the engager apertures being circumferentially elongated in order to accommodate alignment with the fastening points in the bearing mount.

3. The rotor locking device of claim 2, wherein the first mating surface includes multiple teeth arranged around an annulus for mating with the second mating surface, the second mating surface including annularly arranged teeth, wherein a pitch distance between the teeth defines a discrete rotational mating position.

4. The rotor locking device of claim 3, wherein the engager apertures are elongated by a distance corresponding to the pitch distance.

5. The rotor locking device of claim 4, wherein the first mating surface is a female part defined by an annular recessed portion with internally extending teeth, for receiving the second mating surface, the second mating surface being a male part defined by a disk with externally extending teeth.

6. The rotor locking device of claim 1, further comprising:

a mounting frame; and a rod rigidly extending from the shaft engager, opposite to the first mating surface, the rod extending through the mounting frame, to rotatably mount the shaft engager and enable the shaft engager to move to and from contact, via the first and second mating surfaces, with the rotor shaft.

7. The rotor locking device of claim 6, further comprising a drive component arranged to rotate the rod and shaft engager and to impart rotational drive to the rotor shaft.

8. The rotor locking device of claim 7, wherein the drive component includes a gearbox.

9. The rotor locking device of claim 1, wherein the shaft engager includes an alignable indicator on a surface thereof, for alignment with markings on a surface of the rotor shaft and/or the second mating surface.

10. The rotor locking device of claim 9, wherein the markings correspond with locations of hammers extending from the rotor shaft.

11. The rotor locking device of claim 9, wherein the alignable indicator is a slot or aperture formed through the shaft engager, such that the markings become visible when aligned therewith.

12. A crusher comprising:

a rotor shaft; and a rotor locking device mounted to an external region of the crusher, the rotor locking device being arranged to lock a rotational position of the rotor shaft in the crusher, wherein the shaft engager includes a first mating surface arranged for coaxial engagement with a second mating surface located at an end of the rotor shaft, the first mating surface having a plurality of rotational mating positions with the second mating surface, wherein when in at least one of the rotational mating positions the first and second mating surfaces are rotationally interlocked, and a fastening portion extending radially outward at the shaft engager arranged to overlap a bearing mount surrounding the rotor shaft and being fastenable therewith.

* * * * *